US005181874A

United States Patent [19]

Sokolich et al.

[11] Patent Number: 5,181,874

[45] Date of Patent: Jan. 26, 1993

[54] METHOD OF MAKING MICROELECTRONIC FIELD EMISSION DEVICE WITH AIR BRIDGE ANODE

[75] Inventors: Marko Sokolich, Los Angeles; Zaher Bardai, Torrance, both of Calif.

[73] Assignee: Hughes Aircraft Company, Los Angeles, Calif.

[21] Appl. No.: 865,384

[22] Filed: Apr. 8, 1992

Related U.S. Application Data

[62] Division of Ser. No. 675,590, Mar. 26, 1991, Pat. No. 5,136,205.

[51] Int. Cl.[5] ..... H01J 9/14

[52] U.S. Cl. ..... 445/24; 156/656; 156/661.1; 445/50

[58] Field of Search ..... 445/24, 25, 50, ; 156/656, 661.1

[56] References Cited

U.S. PATENT DOCUMENTS

| | | | |
|---|---|---|---|
| 3,647,585 | 3/1972 | Fritzinger et al. | 156/656 |
| 4,054,484 | 10/1977 | Lesh | 156/656 X |
| 4,943,343 | 7/1990 | Bardai et al. | 156/656 X |
| 4,983,878 | 1/1991 | Lee et al. | 313/308 |
| 4,987,377 | 1/1991 | Gray et al. | 313/309 X |
| 5,063,323 | 11/1991 | Longo et al. | 313/309 |

OTHER PUBLICATIONS

R. E. Williams, "Gallium Arsenide Processing Techniques", Tech House, Inc., Apr. 1985, pp. 334–339.

K. Skidmore, "Industry News–The Comeback of the Vacuum Tube: Will Semiconductor Versions Supplement Transistors?", Semiconductor International, Aug. 1988, pp. 15–18.

C. A. Spindt, et al. "Field Emission Array Development", 33rd Int'l Field Emission Symposium, Jul., 1986, pp. 1–11.

*Primary Examiner*—Kenneth J. Ramsey

*Attorney, Agent, or Firm*—Terje Gumestad; Jeannette M. Walder; W. K. Denson-Low

[57] ABSTRACT

A field emission device employs an anode in the form of an air bridge spanning the tip of a field emission cathode. The anode is supported only at its opposite ends, leaving the area under the air bridge open. An array of cathode emitters employ a series of parallel, laterally spaced anode air bridges, with each air bridge spanning a line of cathodes. The lateral spacing between the air bridges facilitates both the removal of underlying photo-resist during fabrication, and the establishment of a uniform vacuum if desired. The clearance between the anode and cathode is substantially less than previously obtainable, resulting in a significant reduction in both size and in the anode's operating voltage level. Fabrication of the air bridge anodes can be integrtaed with the remainder of an integrated circuit.

1 Claim, 2 Drawing Sheets

METHOD OF MAKING MICROELECTRONIC FIELD EMISSION DEVICE WITH AIR BRIDGE ANODE

This is a division of application Ser. No. 675,590, filed Mar. 26, 1991, now U.S. Pat. No. 5,136,205.

BACKGROUND OF THE INVENTION

1. Field of the Invention

This invention relates to field emission devices, and more particularly to field emission triodes (FETs) in which an anode is spaced above an electron-emitting cathode, with current flow between the two controlled by a lateral gate.

2. Description of the Related Art

Vacuum FETs that use semiconductor material and have some significant advantages over transistors have been developed recently. They are operable over a wide temperature range, have very fast speeds for both analog and digital applications, high power efficiency, small and lightweight packages, low cost and resistance to radiation damage. FET developments are described, for example, in Skidmore, "Industry News—The Comeback of the Vacuum Tube: Will Semiconductor Versions Supplement Transistors?", *Semiconductor International*, August, 1988, pages 15–18, and Spindt, et al. "Field Emission Array Development", 33*rd Int'l. Field Emission Symposium*, July, 1986, pages 1–11.

A FET consists of an electron-emitting cathode, an anode which collects electrons given off by the cathode, and a current controlling gate. The cathode terminates in a sharp tip which provides a high electric field concentration. A multiple array of FETs is normally fabricated at one time and operated in parallel for a higher power capacity, with a single common anode structure provided for all of the cathode emitters in the array. Cavity molding techniques for forming the pointed cathodes are described in U.S. Pat. No. 4,307,507 to Gray, et al., and in U.S. patent application Ser. No. 457,208, filed Dec. 26, 1989 by Bardai, et al. and assigned to Hughes Aircraft Company, the assignee of the present invention.

An overall FET fabrication process is described in U.S. Pat. No. 4,943,343 to Bardai et al., also assigned to Hughes Aircraft Company. In this patent a conical gate structure is formed over the conical cathode and spaced therefrom by an insulating layer, while a conical anode structure is formed over the gate and spaced therefrom by another insulating layer. The central portions of the anode and gate structures are then removed, along with the nearby portions of the insulating layers, to produce a final FET structure in which the gate and anode are progressively above but laterally spaced from the cathode. A distinct advantage of this approach is that it significantly reduces the spacing between the cathode and gate, thereby making it possible to operate with lower gate voltages on the order of 10 volts. However, the anode's lateral offset from the cathode emission tip requires a much higher anode voltage, and results in an excessive capture of electrons by the gate.

Another fabrication technique is described in U.S. patent application Ser. No. 552,643, filed Jul. 16, 1990 by Longo et al. and assigned to Hughes Aircraft Company. In this application the gate is a horizontal layer formed upon a vertical insulating wall lateral to the cathode, while the anode is another horizontal layer spaced above the gate by a second wall and again laterally offset from the cathode. A conductive cover plate is mechanically bonded over the top of the anode structure, with both the anode and the cover plate receiving electrons emitted from the cathode. The separate plate and its mechanical bonding process cannot be accurately controlled to very small dimensions, and results in a cathode-anode gap of 50 microns or greater. Furthermore the anode support structure requires a considerable amount of excess processing to fabricate and is not integrable with the fabrication of other circuitry on the same chip.

The desirability of a small clearance between the anode and the cathode emission tip has been recognized. A small clearance requires a proportionately smaller anode voltage to establish the same electric field and emission current; the smaller anode voltage yields a similar reduction in power dissipation. For example, the Skidmore article mentioned above mentions a spacing of 0.5 micron. However, neither this article nor any other of the references proposes any practical way to achieve anything near such a small spacing.

Another technology that is of interest to the present invention, but has developed independently of the FET area, is that of conductive air bridges. Such structures have been used extensively for crossovers of metallic interconnection lines in GaAs analog devices. They are used when the metallization pattern requires that two lead lines cross over each other without electrically connecting. With an air bridge, a span is formed in one of the lines so that it bridges the other line, with air separating the two. As opposed to crossovers that are electrically isolated by means of a dielectric layer between the two lines, which is typical of digital devices, air bridges exhibit low parasitic capacitance, an immunity to edge profile problems and an ability to support a substantial current. They are described, for example, in Williams, *Gallium Arsenide Processing Techniques*, Tech House, Inc., 1984, pages 334–339.

It is desirable to keep air bridge crossover profiles low to maintain a more planar circuit surface. To this end the clearance between the underlying conductor and the bridging conductor is held to not more than one or two microns. The lower limit for the clearance is established by the operating voltages expected for the two lines, and must be kept large enough to maintain an air insulation between the two and prevent any current flow from one line to the other. Since the opposed surfaces of both conductors are normally flat, the electric field between the two will generally be uniform and not exhibit significant concentrations at any one point; this allows for a close spacing between the two lines.

SUMMARY OF THE INVENTION

The present invention seeks to provide a new structure and fabrication method for a field emission device that can be integrated with other circuitry on the same chip with a substantially simplified fabrication process, and that makes possible a very close spacing between opposed anodes and cathodes to reduce the size of the overall device and make it operable at low voltage levels.

To accomplish these goals, an array of field emission cathode tips and current control gates are formed on a substrate; prior fabrication techniques can be used for this purpose. Conductive air bridge anodes are then formed which span respective sets of field emission tips. Each air bridge is supported at its opposite ends, with substantially the entire volume between the air bridge and the underlying substrate and field emission tips/-gate structure left open. The air bridge is generally spaced at least 2 microns, and preferably within the range of about 2-5 microns, above the field emission tips. This results in a low operating voltage and compact FET structure.

As opposed to prior FET arrays in which a common anode plate services an entire array of cathodes, in the present invention a plurality of air bridges are laterally spaced from each other and span respective rows of emitter tips in an array, with each row preferably being only one tip in width. The spacing between the air bridges are utilized during the fabrication process to assist in removing a photoresist support structure from under the air bridges. The air bridges can be deposited over the support structure in a common step with the deposition of other conductive metallization upon the substrate, such as common lead line connections for the gates and cathodes and another common lead connection for the air bridges, thus integrating the fabrication of the air bridges in with the remainder of the integrated circuitry on the substrate. The air bridges are each preferably about 5-15 microns wide, with adjacent air bridges preferably spaced laterally from each other by about 2-10 microns.

These and other features and advantages of the invention will be apparent to those skilled in the art from the following detailed description, taken together with the accompanying drawings, in which:

DETAILED DESCRIPTION OF THE INVENTION

Figure 1A:
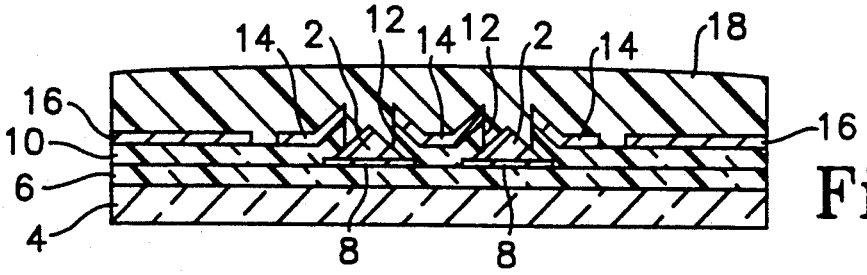
FIGS. 1*a*-1*e* are sectional views showing sequential steps in the fabrication of an FET in accordance with the invention.

FIGS. 1*a*-1*e* show the preferred fabrication steps to form the improved FET of the present invention. Although a three-terminal FET is shown, the invention is also applicable to two-terminal cathode-anode devices. An array of field emitter elements or cathodes 2 is formed on a substrate 4, preferably as described in U.S. Pat. No. 4,943,343 mentioned above. This fabrication technique allows for a close proximity of the gate to the cathode, and thus a low gate voltage. Since the anode voltage must be at least as great as the gate voltage, the low anode voltages made possible by the present invention are realizable only with an FET structure that also provides for a low gate voltage.

Cathodes 2 are typically in the form of pyramids or cones, with an upper pointed tip from which electrons are emitted under the influence of an applied electric field. The cathodes 2 are constructed from an electrically conductive material such as molybdenum or polycrystalline silicon. They may be coated with a low work function material such as titanium carbide, which facilitates electron emission from their tips. Although only two cathodes 2 are shown, they are generally formed in much larger arrays to increase the power handling capability of the overall array. The substrate 4 is typically formed from a semiconductor such as silicon or GaAs.

The cathodes 2 are formed on the substrate 4 over an intervening oxide layer 6, with a metallization layer 8 on the surface of oxide layer 6 underlying the cathodes and making electrical contact therewith. The metallization layer 8 functions as a lead line to bring an electrical voltage signal to the cathodes, and connects the cathodes in common.

A second insulative oxide layer 10 lies over the first oxide layer 6 and laterally abuts the lower sidewalls of the cathodes 2. The upper oxide layer 10 slopes upward near the edges of the cathodes, and includes annular openings 12 over the central cathode portions. A conductive metallic layer 14 is deposited on top of the upper oxide layer 10 in the vicinity of the cathodes, so that the metallic layer encircles the tip of each cathode just above the cathode. Metal layer 14 functions as the gate for the FETs, and extends into or out of the page so that it can receive a control signal. As described in U.S. Pat. No. 4,943,343, the upper oxide layer 10 and gate metallization 14 initially extend completely over the top of field emitter elements 2, but are then etched to expose the upper portions of the cathodes. This results in a self-aligned gate structure.

Conductive layers 16 are deposited along opposite sides of the cathode array, and form contacts for the anode to be fabricated. Anode contact layer 16 is spaced away from gate metallization 14 to electrically isolate the two. A layer of photoresist 18 is then laid down over the entire structure.

Figure 1B:
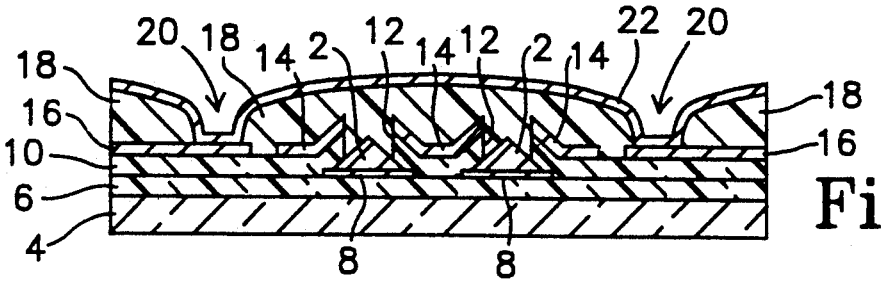

The next step in the fabrication process is shown in FIG. 1*b*. Openings 20 are formed in the photoresist layer 18 in alignment with the inward ends of anode contact layer 16 by a conventional photoresist exposure and development process. The shape of the openings 20 will match that of the anode to be formed, and will generally assume the form of a trench. A metallic membrane 22 is then deposited over the photoresist 18 and exposed portions of the anode contact layers 16 to establish a plating base for the anode.

Figure 1C:
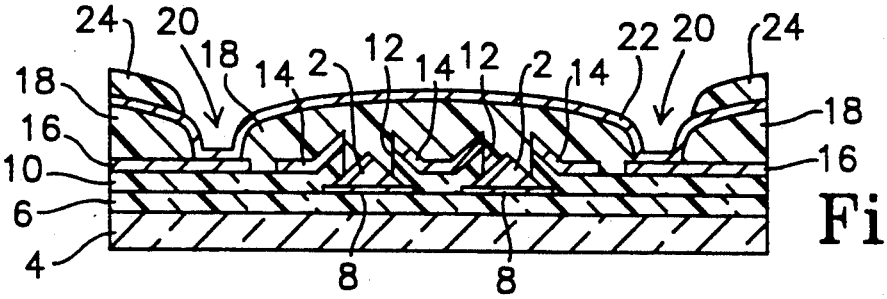
Figure 1D:
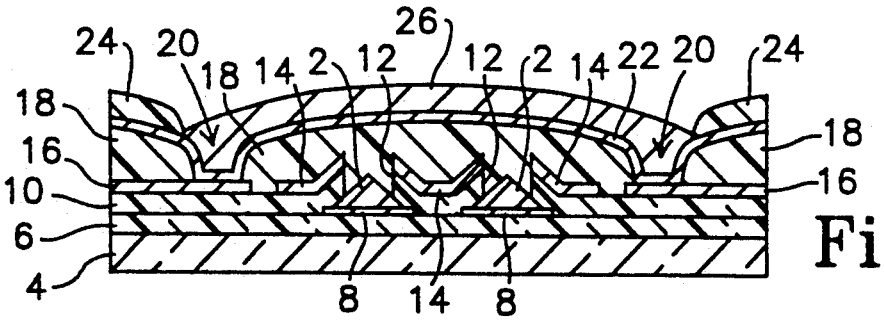
Figure 1E:
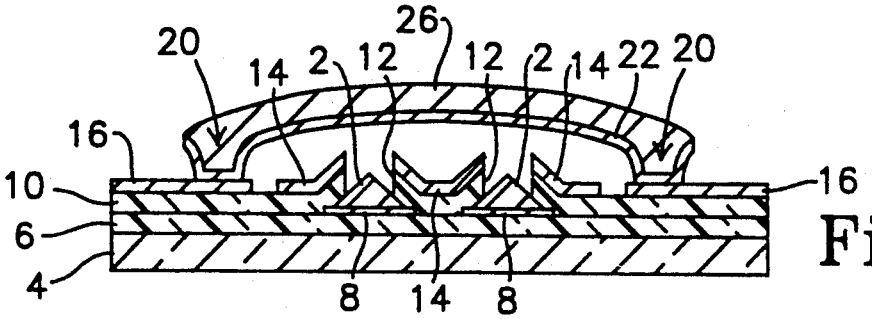

A second layer of photoresist 24 is next applied over the anode plating layer 22 and then exposed and developed so that the remaining portions of photoresist layer 24 are on the opposite sides of anode openings 20 from the emitter array, as shown in FIG. 1*c*. Thus, only those portions of membrane 22 which span the emitter array or line the anode openings 20 are exposed. A metal anode layer 26 is then plated onto the exposed membrane 22, as illustrated in FIG. 1*d*. The remaining portions of the upper photoresist layer 24 are now removed, followed by etching away the exposed membrane layer 22 lateral to the anode 26, and finally by dissolving the lower photoresist layer 18. The resulting FET structure is shown in FIG. 1*e*. It is supported on the substrate only at its opposite ends, with the entire volume between it and the underlying substrate and cathode/gate structure left open.

The metal anode 26 forms an air bridge over the field emitter and gate elements. While its method of fabrication is similar to that employed in prior air bridges used for metallization crossovers, its function is totally different. Whereas the purpose of the prior crossover air bridges is to electrically isolate the bridging metal from the underlying conductor, the purpose of the present anode air bridge is to establish an electric field between the cathodes 2 and the air bridge such that an emission of electrons from the cathodes, and a current flow between the cathodes and air bridge anode, takes place over a desired voltage operating range. As opposed to crossover air bridges which are deliberately held to a clearance of less than 2 microns, the clearance of the air bridge anode 26 over the underlying cathode emitter tips is at least about 2 microns with present fabrication capabilities, and preferably about 2–5 microns.

Figure 2:
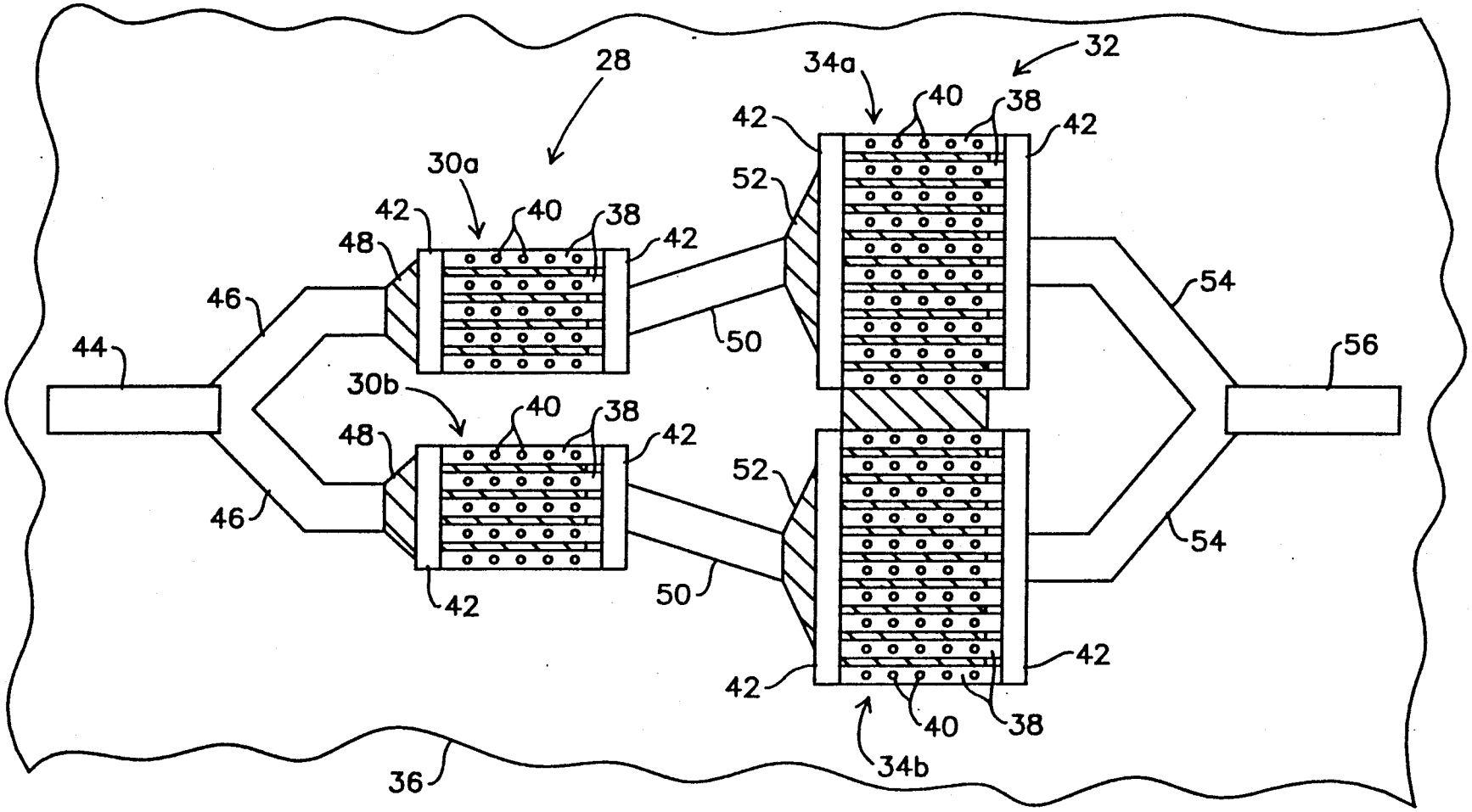
FIG. 2 is a plan view of a power amplifier employing FET arrays in accordance with the invention.

As mentioned above, the FET is normally fabricated as part of an overall array. A number of such arrays are depicted in FIG. 2, which illustrates a two-stage FET power amplifier. The first stage 28 is shown consisting of a pair of 5×5 FET arrays 30*a* and 30*b*, while the second stage 32 includes a pair of 5×10 arrays 34*a*, 34*b*. The devices are all fabricated upon a common substrate 36.

Each array includes a series of parallel, laterally spaced air bridge anodes 38, with each air bridge spanning a row of cathode emitters 40 (the emitters are shown in solid lines in the figure because of their small dimensions, but are actually hidden below their respective air bridges). While each air bridge might be made wide enough to span more than one row of cathodes, in the preferred embodiment they are limited to widths of one row each to maximize the total spacings between the air bridges. This is helpful in both removing the underlying photoresist during fabrication and in evacuating the device during operation, as discussed below. The air bridges within each array are connected in common at their opposite ends by metallized connector strips 42. An input gate signal for the first stage is brought in via a bonding pad 44 and surface metallizations 46 on the substrate, which connect to common gate contact layers 48. The air bridge connector bars 42 are vertically spaced from the underlying gate contact layers 48 by dielectric layers (not shown). Contact metallization (not shown) for the cathode emitters would also be brought in along the substrate, generally orthogonal to the gate lead lines, and separated therefrom by dielectric layers as illustrated in FIG. 1*e*.

The physical construction of the second amplifier stage 32 is similar to that of the first stage. Gate inputs to the second stage are provided from the air bridge anodes of the first stage via surface metallizations 50, and connect to the gates of the second stage via gate contact layers 52. Again, cathode emitter potentials for the second stage would be brought in via appropriate metallization lines (not shown). The output from the second stage 32 is taken from the air bridge connector bars 42, via surface metallizations 54, to an output bonding pad 56.

One of the distinct advantages of the parallel but spaced anode air bridge configuration is that it significantly simplifies both the removal of photoresist from under the air bridges during the fabrication process, and the application of a vacuum to the area below the air bridges if this is desired during operation. If a single continuous anode were employed for all of the cathode emitters within each array, it would be difficult to have the photoresist solvent access the entire volume below the air bridge, while still maintaining a low clearance between the anode and cathode to enable operation at low voltage levels. Similarly, the relatively large anode surface area and the low clearance under the air bridge would also impede the establishment of a uniform vacuum. By forming a series of laterally spaced air bridges instead of using a single continuous anode for each array, the accessibility of both photoresist solvent and a vacuum to the operative region between the anode and cathodes is significantly enhanced.

As discussed in further detail below, the air bridges preferably have a clearance of about 2–5 microns above the tips of the cathode emitter tips. Within this range, the air bridges are each preferably about 5–15 microns wide, depending upon the cathode configuration, and adjacent air bridges are laterally spaced from each other preferably by about 2–10 microns. A suitable air bridge geometry would have the air bridges about 10 microns wide, about 100 microns in length, and with a lateral spacing between adjacent air bridges of about 5 microns.

Another distinct advantage of the invention is that it allows the formation of the air bridge anodes to be integrated in with the fabrication of other metallized areas on the substrate. This simplifies and speeds up the fabrication process, reduces its costs, and offers the potential of a higher yield. In the implementation of FIG. 2, the air bridges could be deposited in the same step as the deposition of the input bonding pad 44 and gate lead line 46 for the first stage, the first stage anode-second stage grid interconnects 50, the anode lead lines 54 and output bonding pad 56 for the second stage, and additional metallizations needed on other areas of the chip.

The new air bridge anode approach allows the anode to be brought much closer to the tip of the cathode emitter than has previously been feasible, and this results in a substantial reduction in both anode voltage levels and power dissipation. As compared with a previously achievable anode-cathode spacing of about 50 microns, a 5 micron spacing with the present invention permits both the anode potential and the power dissipation to be reduced by a factor of 10, with no loss in either the electric field at the emitter tip due to the anode potential, or in the emission current. For example, with a 5 micron clearance and an anode potential of 25 volts, the field at the emitter tip will be 50 kV/cm, the emission current 10 microamps, and the power dissipation 0.25 mW. For the approximately 50 micron spacing achievable with prior approaches, a comparable emission current would require an anode potential of 250 volts and a power dissipation of 2.5 mW.

Another advantage of the low anode voltage is that it is below the ionization potential of the noble gases. Conventional hermetic sealing techniques can be used to package the device, and it need not be operated in an ultra-high vacuum. Further development is expected to make the device operable in ambient air.

Because it can be integrated in a very small area, the FET structure allows for the realization of integrated circuits using field emission devices. Such integrated circuits can be made as small as semiconductor integrated circuits, and much smaller than existing field emission or thermionic emission circuits. Unlike their semiconductor counterparts, however, these field emission circuits will be relatively insensitive to heat and ionizing radiation, making them suitable for space and high temperature applications.

While particular illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A method of making a field emission device, the field emission device comprising a substrate, an array of field emission tips on the substrate and a plurality of rows of conductive air bridges spanning the array of field emission tips, wherein the air bridges are formed by the process comprising the steps of:

depositing a first layer of photoresist over the substrate covering the field emission tips;

forming openings in the first layer, the openings having the shape and spacing of the air bridges;

forming a metallic membrane over the openings to form a plating base for the air bridges;

forming a second layer of photoresist over the substrate covering the metallic membrane and exposed portions of the first layer;

forming second openings in the second layer, the second openings having the shape and spacing of the air bridges and exposing portions of the metallic membrane;

forming a metal layer over the second openings; and removing the remaining portions of the first and second layers.

* * * * *